United States Patent [19]

Kiguchi et al.

[11] Patent Number: 4,967,141

[45] Date of Patent: Oct. 30, 1990

[54] METHOD OF TAKING OUT AND STORING ENERGY IN A SUPERCONDUCTIVE RING OR COIL

[75] Inventors: Masashi Kiguchi; Yoshimasa Murayama, both of Koganei, Japan

[73] Assignee: Hitachi, Ltd., Tokyo, Japan

[21] Appl. No.: 235,529

[22] Filed: Aug. 24, 1988

[30] Foreign Application Priority Data

Aug. 24, 1987 [JP] Japan ..... 62-208120

[51] Int. Cl.[5] ..... H01F 36/00

[52] U.S. Cl. ..... 323/360; 363/14; 505/725

[58] Field of Search ..... 174/15.4; 307/245, 306; 323/360; 336/DIG. 1; 363/14

[56] References Cited

U.S. PATENT DOCUMENTS

| | | | |
|---|---|---|---|
| 3,956,727 | 5/1976 | Wolf | 174/15.4 |
| 4,078,747 | 3/1978 | Minovitch | 335/216 |
| 4,122,512 | 10/1978 | Peterson et al. | 363/14 |
| 4,370,568 | 1/1983 | Lumley | 307/306 |
| 4,409,579 | 10/1983 | Clem et al. | 174/15.4 |
| 4,414,461 | 11/1983 | Wolf | 336/DIG. 1 |
| 4,599,519 | 8/1986 | Boenig | 363/14 |
| 4,695,932 | 9/1987 | Higashino | 363/14 |

OTHER PUBLICATIONS

Masuda et al., "Introduction to Superconductive Energy", Ohm-sha Edition, 1, vol. 1, p. 186.

*Primary Examiner*—Patrick R. Salce
*Assistant Examiner*—Jeffrey Sterrett
*Attorney, Agent, or Firm*—Antonelli, Terry, Stout & Kraus

[57] ABSTRACT

A superconductive ring or coil is irradiated with a light ray so that its superconducting state is destroyed for a short period of time. Under the destruction of the superconducting state, removal of energy from the superconductive ring or coil or storage of energy therein is stably controlled.

17 Claims, 2 Drawing Sheets

METHOD OF TAKING OUT AND STORING ENERGY IN A SUPERCONDUCTIVE RING OR COIL

BACKGROUND OF THE INVENTION

This invention relates to a method of taking out and storing energy for use in electric power storage using a superconductor and more particularly to an energy taking out and storing method suitable for controlling energy in a large current storage ring.

Conventionally, a method for removing energy stored in a superconductive coil has been discussed in "Introduction to Superconductive Energy" by Masayoshi Masuda et al, Ohm-sha, Edit. 1, Vol. 1, page 186.

The above conventional technique does not however take into consideration the connection of a circuit to the superconductive coil. The circuit connection is accompanied by a change in current which causes discharge of magnetic field energy stored in the superconductive coil. The thyristor is possibly deteriorated by a surge current and in the extreme, broken down. Further, it is difficult to remove portions of the stored energy in small amounts as necessary. Discharge of a large amount of energy is dangerous as well as difficult to use.

The conventional technique also fails to take it into account the need to stably store energy in the superconductive coil.

SUMMARY OF THE INVENTION

An object of this invention is to control storage and removal of energy to be stored in the form of a persistent current in a superconductive ring or coil.

The above object can be accomplished by irradiating a light ray on the superconductive ring or coil to destroy the superconducting state for a short period of time and removing energy under this condition or normal (conducting) state.

The irradiation of a pulsed light ray may suffice provided that the light ray has at least a wavelength corresponding to the minimal energy necessary to destroy Cooper pairs present internally in the superconductive ring and turn them into quasi-particles.

When Cooper pairs responsible for superconductivity are excited by a light ray having energy which is larger than an energy gap present in the conduction band, they become unpaired and turn into quasi-particles. The quasi-particles do not participate in superconductivity. The energy gap approximately corresponds to the critical temperature and is near the nitrogen temperature. The energy gap corresponds to energy of a far infrared ray. Accordingly, the superconducting state can be destroyed by the irradiation of a light ray having higher energy than that of the far infrared ray and ranging from for example, a near infrared ray to an ultraviolet ray. When the irradiation of the light ray is stopped, the excited quasi-particles are again paired and the superconducting state recovers.

In an alternative embodiment, by managing the temperature of the superconductor so that it is raised above the critical temperature, while under the irradiation of a light ray, and managing the temperature so that it falls below the critical temperature within a short period of time after the irradiation of the light ray is stopped, the superconducting state can be destroyed for a short period of time. After the irradiation of the light ray is stopped, the temperature falls at a rate which depends on such factors as thermal resistance, thermal capacity and ambient temperature. Since the superconductor is thermally non-conductive, the temperature decreasing speed can be promoted by providing a heat sink at a portion where the light ray is irradiated. This suppresses spreading of heat over the entirety of the superconductive ring or coil and permits local destruction of the superconductor. Since the portion where superconductivity is destroyed becomes resistive, heat is generated in this portion. If the generated heat causes the temperature of this portion to rise beyond the critical temperature, the superconducting state can not be recovered even when the irradiation of the light ray is stopped. This disadvantage can be prevented by decreasing the pulse duration time of the irradiated light ray and using the heat sink additionally as necessary.

Voltage develops across a portion or portions of the superconductive ring or coil where superconductivity is destroyed in the above manner and the voltage is taken out as a pulse current flowing through lead wires. As the lead wires, normal electric wires or superconductors may be used. By making impedance of the take-out circuit smaller than that of the irradiated portion, efficiency in removing energy can be correspondingly high. In an alternative, by taking advantage of the fact that part of a magnetic field confined within the superconductive ring escapes to the outside of the ring when superconductivity is destroyed for a short magnetic field which changes with the partial escape of the magnetic field to obtain electromotive force induced in the coil or solenoid. This coil or solenoid may be made of a normal electric wire substituting for a superconductor. By placing the coil or solenoid inside of the superconductive ring or coil, the magnetic flux can be utilized efficiently. The diameter, number of turns and length of each of the coil or solenoid and superconductive ring or coil may be designed so as to match the load on the secondary circuit, taking into consideration self-inductance and mutual inductance. For example, when the superconductive ring has a radius of a and the solenoid has a length of 2l, a sectional area of s and n turns per unit length is placed inside of the superconductive ring in centered relationship therewith, electromotive force induced in the solenoid is $$e_{12} = -L_{11}\frac{dI_1}{dt} - L_{12}\frac{dI_2}{dt}$$

where $I_1$ is a current flowing through the solenoid, $I_2$ is a current flowing through the superconductive ring, $L_{11}$ is a self-inductance of the solenoid and $L_{12}$ is a mutual inductance. The self-inductance $L_{11}$ and mutual inductance $L_{12}$ are given by $$L_{11} = 2\mu_o n^2 ls$$

$$L_{12} = \frac{\mu_o snl}{\sqrt{a^2 + l^2}}$$

wherein $s<a$ and $\mu_o$ represents vacuum magnetic permeability. Thus, the electromotive force $e_{12}$ is determined by taking into account the rate of change of $I_2$ and impedance of the circuit through which $I_1$ flows. Values of n, l, s and a are so selected as to maximize $e_{12}$.

The change of magnetic flux can also be utilized to take out energy in a manner to be described below.

A magnetic shield member surrounding the superconductive ring or coil laterally of it is partly cut to form a gap through which the magnetic flux escapes from the superconductive ring to the outside of the shield member. The escaping magnetic flux passes through a coil or solenoid placed in the gap to generate electromotive force in the coil or solenoid. The magnetic shield member acts to efficiently guide the escaping magnetic field to the coil or solenoid. The magnetic shield member may be made of permalloy as is usual in this field of art but in consideration of the fact that permalloy is less effective to shield such a high frequency magnetic field as in the superconductive coil, the magnetic shield member may preferably be formed of a superconductor.

The thus taken-out current is of a pulse current and converted into a DC current by means of a pulse integrator, a half-wave rectifier circuit, a full-wave rectifier circuit or the like which is well known in the art.

The speed at which energy is taken out can be controlled by changing time over which the superconducting state is destroyed. To this end, the pulse width of the irradiated light ray may be changed or alternatively, the repetition frequency of the pulsed light ray may be changed. Adjusting the repetition frequency is easy to control because the temperature rise does not change for each pulse. But the two modes may be used in combination for control. Further, rectified voltage or current may be monitored and used to be fed back to the pulse width of irradiated light ray or the repetition frequency, thereby setting up a stabilized power supply.

Since the portion where superconducting state is destroyed under irradiation of the light ray becomes resistive, energy is consumed and lost in the form of Joule heat. This loss can be minimized by connecting a by-pass circuit, having a lower impedance than the superconductive ring or coil assumes in the normal conducting state, in parallel with the resistive portion. No current flows through this circuit in the superconducting state but a current passes through this by-pass circuit when superconductivity is destroyed, causing a minimal loss in the low impedance of the by-pass circuit. The by-pass circuit may be formed of a mere low-resistance resistor or a capacitor which assumes a low impedance for the pulse. Alternatively, the low-resistance resistor and the capacitor may be used in combination. The provision of the by-pass circuit is particularly effective for the case where energy is taken out through the medium of the magnetic field.

A way of storing energy in the superconductive ring or coil is, for example, as follows:

While the superconductive ring is irradiated with a light ray, a current is passed through the ring under the influence of the mutual inductance with the solenoid coil. When the irradiation of the light ray is stopped subsequently, the ring is brought into the superconducting state. Therefore, the magnetic flux is confined within the ring, and a persistent current flows as stored energy.

Typically, the present invention may use the superconductive ring or coil or the magnetic shield member using a superconductor which is made of a superconductive material having an oxygen deficit type perovskite structure expressed by a general chemical formula of $(RE)_1 M_2Cu_3O_{7-z}$ or a $K_{2NiF4}$ type structure. In the general chemical formula, RE represents an element of La, Y, Sr, Yb, Lu, Tm, Dy, Sc, Ce, Pr, Nd, Sm, Eu, Gd, Tb, Ho or Er and M represents an element of Ba, Sr, Ca or K.

In addition to the superconductive material of the above structure, a superconductive material of such a metal as Al, Zn, Ga, Cd, In, Sn, Hg, Tl, Pb, Ti, V, Zr, Nb, Mo, Tc, Ru, La, Hf, Ta, W, Re, Os, Th, Pa or U, such an alloy as Nb—Ti or Pb—Ag or such a compound as $Nb_3Sn$, MoN, $Nb_3Si$, Nb3Ga, $Nb_3Ge$ or $Nb_3(Al_{0.8}, Ge_{0.2})$ may also be used.

DESCRIPTION OF THE PREFERRED EMBODIMENTS

The invention will now be described by way of example with reference to the accompanying drawings.

Embodiment 1

Figure 1:
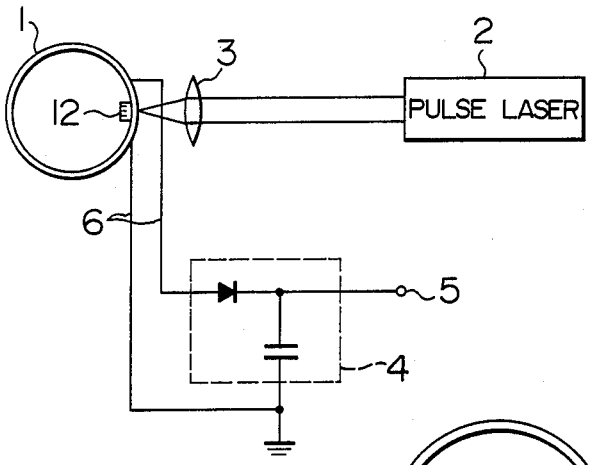
FIG. 1 is a schematic diagram showing a method for direct take-out of current according to an embodiment of the invention.

In an embodiment shown in FIG. 1, an output light beam from a pulse laser 2 is collected, by means of an optical system 3, on a portion of a superconductive ring 1 through which a persistent current is flowing. A heat sink 12 is disposed near the irradiated portion. Lead wires 6 extending from opposite ends of the irradiated portion connect to an output terminal 5 through a rectifier 4. A mode locked $Nd^{3+}$: YAG laser is used as the pulse laser 2 and the pulsed output light beam has a pulse width of 100 ps and a repetition frequency of 82 MHz. The light source may also include the sunlight ray, various kinds of lamp such as a xenon lamp, incandescent lamp or mercury lamp, or various kinds of laser such as an Ar, Kr, He-Ne, $N_2$, excimer, Nd: glass, $CO_2$, CO, color center, metal vapor, coloring matter or semiconductor laser. Further, the second harmonic generation, third harmonic generation or fourth harmonic generation of the lasers enumerated above may also be used. These lasers may be mode locked or Q-switched. Especially, the semiconductor laser is easy to handle when driven directly with current pulse and may preferably be used. The laser oscillating with continuous wave may be attached with a mechanical shutter, an optical shutter using an electro-optic device or acoust-optic device or an optical switch to generate a pulsed light ray. The laser pulse train may be chopped with a frequency which is lower than the repetition frequency of the laser by using a shutter so as to control the energy take-out speed. Under the irradiation of the pulsed light ray, the superconducting state is destroyed instantaneously and current can be taken out through the lead wires 6. The current is rectified by a simple rectifier comprised of a diode and a capacitor to provide a DC voltage at the output terminal 5.

The light ray is collected by means of a lens in the present embodiment but in some applications it may preferably be irradiated directly or conversely spread for irradiation in order to adjust or suppress the temperature rise due to light ray irradiation which might destroy superconductivity.

The superconductor used in the embodiment of the invention is an oxide superconductor of Y-Ba-Cu-0 having a critical temperature of 90 K, which is placed within a cryostat so as to be maintained at 77 K.

Embodiment 2

Figure 2:
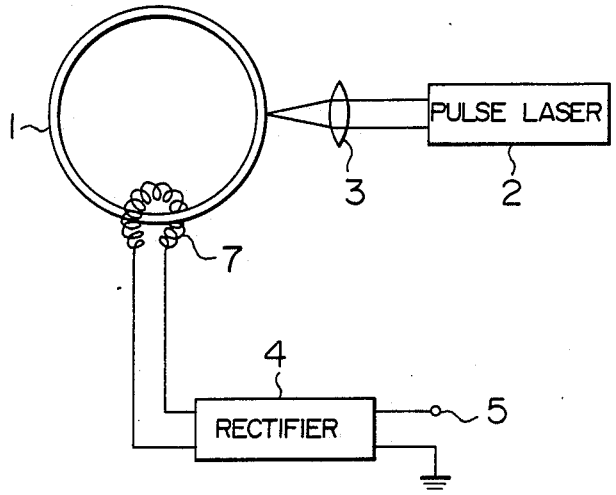
FIGS. 2 and 3 are schematic diagrams showing methods of taking out energy through the medium of the magnetic field according to other embodiments of the invention.

FIG. 2 shows another embodiment of the invention. Structurally, this embodiment is identical to embodiment 1 with the exception that a ring solenoid 7 substituting for the lead wires winds about the superconductive ring 1. When current flowing through the superconductive ring 1 changes under the irradiation of the light ray, the magnetic field associated with the current also changes to generate electromotive force in the solenoid disposed as shown. Since voltage polarities at opposite ends of the solenoid oscillate, the use of a full-wave rectifier is effective. Although the single solenoid is disposed in this embodiment, a plurality of solenoids may be provided.

Embodiment 3

Figure 3:
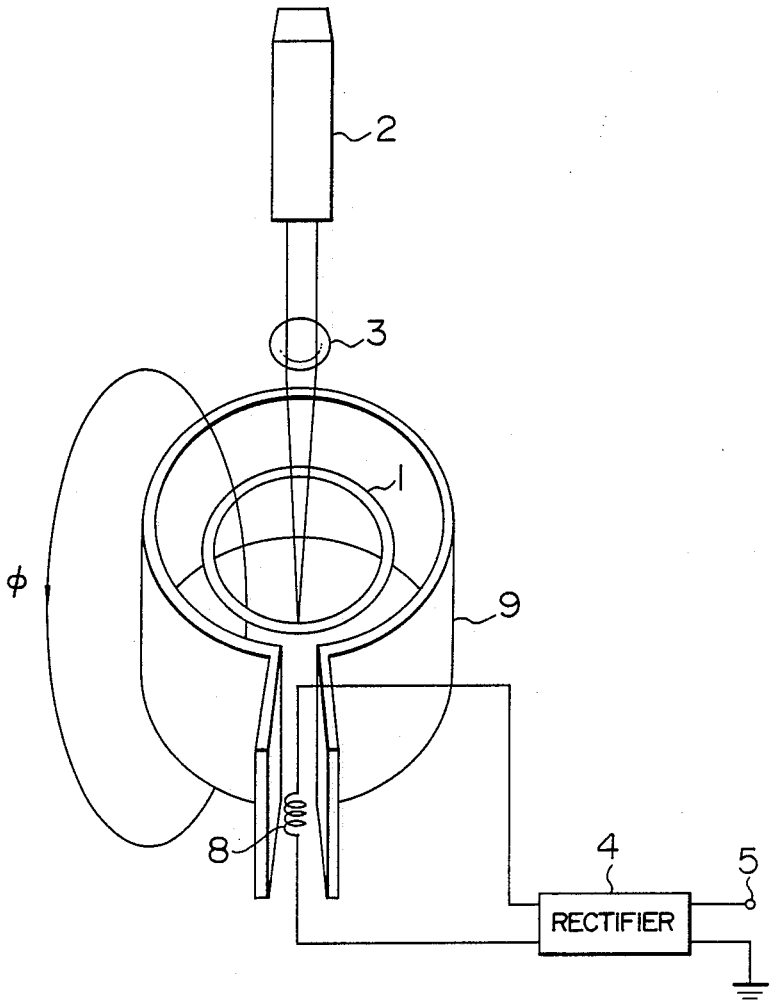

FIG. 3 shows still another embodiment of the invention. A magnetic shield member 9 made of a superconductor surrounds the superconductive ring 1 laterally of it and it is partly cut to form a gap in which a solenoid 8 is placed. Excepting the above, this embodiment is structurally identical to embodiment 1. For convenience of illustration, the superconductive ring 1 and superconductive magnetic shield member 9 are depicted as having a large diameter ratio but practically, it is preferable that the diameter ratio is approximate one. With this construction, magnetic flux $\phi$ confined within the superconductive ring 1 is permitted to wind about the magnetic shield member 9 as illustrated in FIG. 3. When superconductivity is destroyed by the irradiation of light ray, the magnetic flux escapes from the superconductive ring and because of the provision of the magnetic shield member 9, the escaping magnetic flux is permitted to go through the gap under the influence of the Meissner effect. As a result, the magnetic flux effectively passes through the solenoid 8 or coil placed in the gap to induce a current in the solenoid and the current is rectified and taken out. In place of the single solenoid, a plurality of solenoids may be disposed along the gap.

Embodiment 4

Figure 4:
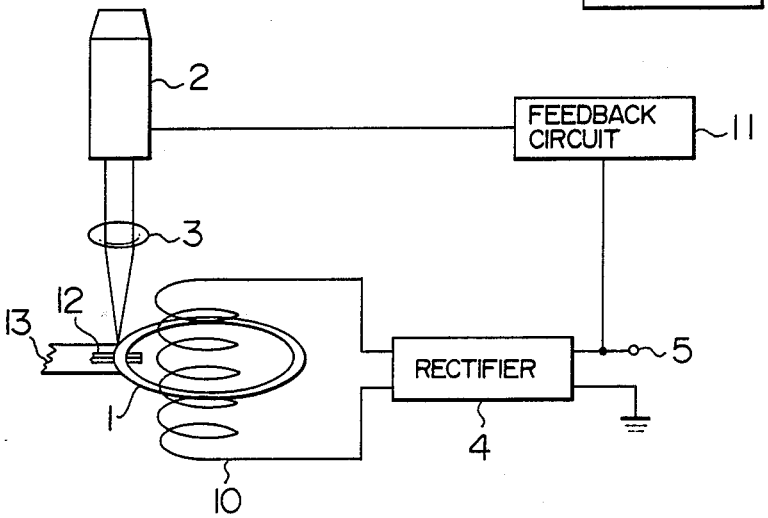
FIG. 4 is a schematic diagram showing methods of storing and taking out energy through the medium of the magnetic field according to further embodiments of the invention.

Referring to FIG. 4, still another embodiment of the invention will be described. A solenoid 10 is placed inside of the superconductive ring 1 in centered relationship therewith. The heat sink 12 is disposed at the irradiated portion and a resistor 13 is connected in parallel with the irradiated portion. Excepting the above, this embodiment is structurally identical to embodiment 1. Under the irradiation of light ray, the superconducting state is destroyed at the portion of superconductive ring 1 where the light ray is irradiated and the magnetic flux confined within the ring escapes through the portion now being in the normal conducting state, thereby causing the magnetic flux passing through the solenoid 10 to change to generate electromotive force which is taken out as energy.

The superconductive material of Y-Ba-Cu-O has a resistivity of about $10^{-2}$ Ωcm in the normal conducting state. When the ring has a sectional area of $10^{-2}$ $cm^2$ and the irradiated portion has a length of $10^{-1}$ cm, the resistance of the irradiated portion is estimated to be about $10^{-1}$ Ω. Under this condition, by connecting 10 resistors 13 each having a resistance of 0.1 Ω in parallel with the irradiated portion, a resultant resistance of 0.01 Ω can be obtained across the irradiated portion. The parallel connection of 10 resistors is effective to decrease power consumption per resistor and mitigate the load on each resistor. In this manner, energy loss can be reduced to about 1/10 as compared to the case where the parallel connection of resistors is not set up. The resistor may be replaced with a small-capacitance capacitor.

A feedback circuit 11 feeds back part of the output to control the width of laser pulse or the repetition frequency of laser oscillation, thereby ensuring that the energy take-out speed can be controlled to stabilize the output. The mode locked laser, in which is difficult to change the repetition frequency, is unsuitable for feedback control and a GaAlAs semiconductor laser driven with current pulse may preferably be used as the pulse laser 2.

In the case of destroying the superconductivity under the influence of the temperature rise due to the irradiation of light ray, intensity of light may be controlled in place of the repetition frequency.

Embodiment 5

A further embodiment of the invention will be described by referring again to FIG. 4. Structurally, this embodiment is identical to embodiment 4, with the solenoid 10 placed inside of the superconductive ring 1 storing no energy in centered relationship therewith. Under the irradiation of the light ray, the superconducting state is destroyed at the irradiated portion of the superconductive ring 1. When a current is passed through the solenoid 10, a current flows through the superconductive ring 1 under the influence of the mutual inductance. The light ray used for irradiation may be a continuous wave. When the irradiation of light ray is stopped subsequently, the superconductive ring recovers the superconducting state in which the magnetic flux is confined within the ring and a persistent current flows to store energy.

As described above, according to the invention, since energy stored in the superconductive ring can be taken out by a small amount, the energy can be used more easily than energy taken out by a large amount and can be used safely even when a large current is stored. Further, the output can be stabilized to provide a stable DC power supply and the field of utilization can be extended.

We claim:

1. A method of taking out energy wherein a pulsed light ray is repetitively irradiated on a superconductive ring or coil storing energy to take out the stored energy.

2. A method of taking out energy in accordance with claim 1 wherein said pulsed light ray repetitively irradiates any portion of said superconductive ring or coil and energy is taken out in response to said pulsed light ray repetitively irradiating said superconductive ring or coil.

3. An energy take-out method according to claim 1 wherein the light ray is passed through an optical system and locally irradiated on at least one portion of said superconductive ring or coil.

4. An energy take-out method according to claim 1 wherein the output is rectified using at least one of a half-wave rectifier, a full-wave rectifier and a pulse integrator.

5. An energy take-out method according to claim 1 wherein current is taken out through at least one of normal conductive and superconductive lead wires connected to opposite ends of a portion where the light ray is irradiated.

6. An energy take-out method according to claim 1 wherein a change in magnetic field caused by destruction of superconductivity under the irradiation of the light ray is detected and converted into electric power by means of a coil or solenoid.

7. An energy take-out method according to claim 6 wherein said coil or solenoid is placed inside of said superconductive ring.

8. An energy taken-out method according to claim 6 wherein said coil or solenoid is disposed in a gap formed by partly cutting a magnetic shield member which surrounds said superconductive ring or coil laterally of it.

9. An energy take-out method according to claim 1 wherein a heat sink is disposed near a portion of said superconductive ring or coil where the light ray is irradiated.

10. An energy take-out method according to claim 1 wherein the irradiated light ray is a pulsed light ray and the pulse width of the pulsed light ray is changed to control the energy take-out speed.

11. An energy take-out method according to claim 1 wherein the irradiated light ray is a pulsed light ray and the repetition frequency of the pulsed light ray is changed to control the energy take-out speed.

12. An energy take-out method according to claim 1 wherein a circuit having a lower impedance than an impedance said superconductive ring or coil assumes when brought into the normal conducting state is connected in parallel with a portion of said superconductive ring or coil where the light ray is irradiated.

13. A method of storing energy in accordance with claim 1, wherein said light ray has a wavelength which corresponds to energy at least equal to an energy gap of said superconductive ring or coil.

14. A method of storing energy wherein a pulsed light ray is repetitively irradiated on a superconductive ring or coil to store energy in said superconductive ring or coil.

15. An energy storing method according to claim 14 wherein at least one of a coil and solenoid is placed inside of said superconductive ring to supply current necessary for energy storage.

16. An energy storing method according to claim 14 wherein the light ray is passed through an optical system and locally irradiated on at least one portion of said superconductive ring or coil.

17. A method of storing energy in accordance with claim 15, wherein said light ray has a wavelength which corresponds to energy at least equal to an energy gap of said superconductive ring or coil.

* * * * *